United States Patent [19]

Hoshi et al.

[11] 4,251,269

[45] Feb. 17, 1981

[54] METHOD FOR CONTROLLING STEEL MAKING PROCESS UNDER REDUCED PRESSURES

[75] Inventors: Fumio Hoshi; Yuzo Saita, both of Tokuyama; Akira Fujisawa, Kyoto, all of Japan

[73] Assignee: Nisshin Steel Co., Ltd., Japan

[21] Appl. No.: 938,013

[22] Filed: Aug. 30, 1978

[30] Foreign Application Priority Data

Sep. 10, 1977 [JP] Japan ..... 52-109247

[51] Int. Cl.[3] ..... C21C 5/30

[52] U.S. Cl. ..... 75/60; 75/59

[58] Field of Search ..... 75/60, 59, 49

[56] References Cited

U.S. PATENT DOCUMENTS

| | | | |
|---|---|---|---|
| 3,649,246 | 3/1975 | Fulton | 75/59 |
| 3,666,439 | 5/1972 | Ramachandran | 75/49 |
| 3,700,429 | 10/1972 | Ramachandran | 75/59 |
| 3,748,122 | 7/1973 | Ramachandran | 75/59 |
| 3,920,447 | 11/1975 | Schroeder | 75/59 |
| 3,940,263 | 2/1976 | Morello | 75/59 |

*Primary Examiner*—P. D. Rosenberg

*Attorney, Agent, or Firm*—Kane, Dalsimer, Kane, Sullivan and Kurucz

[57] ABSTRACT

Method of controlling steel making process under reduced pressures, comprising forming an intimate mixture of an exhaust gas and a measured quantity of a reference gas; mass spectrometrically monitoring a sample of the mixture for the ionization currents for selected peaks with which the CO, $CO_2$, $N_2$ and reference gas in the sample are concerned; determining the rate or amount of decarburization of the molten steel from the measured value of the quantity of the reference gas in the mixture and the measured values of the ionization currents, and; controlling the process according to the determined value of the rate or amount of decarburization.

11 Claims, 3 Drawing Figures

METHOD FOR CONTROLLING STEEL MAKING PROCESS UNDER REDUCED PRESSURES

BACKGROUND OF THE INVENTION

1. FIELD OF THE INVENTION

The present invention relates to a method for a dynamic or real time control of a steel making process involving decarburization of molten steel in a closed zone under reduced pressures and compulsive evacuation of a exhaust gas comprising CO, $CO_2$ and $N_2$ from the closed zone. Particularly, the present invention relates to such a method wherein the carbon content of the steel at the end point of the decarburization process may be precisely controlled to a preset value by promptly detecting the carbon content or rate of decarburization of the molten steel being processed at any desired instance and by controlling the process in accordance with the detected carbon content or rate of decarburization.

2. BRIEF DESCRIPTION OF PRIOR ART

Widely practiced is a steel making process which involves decarburization of molten steel under reduced pressures. In one typical process for producing stainless steel which is generally referred to as the VOD process, chromium-containing molten steel is vacuum decarburized in a ladle mounted in a closed vessel by blowing oxygen onto the molten steel which may be stirred by bubbling argon.

Recent progress in the art has made it possible to produce various kinds of steel, and in consequence, it has become increasingly important to promptly detect and determine certain parameters indicative of the state of the molten steel being processed and to control the process in accordance with the determined values of the parameters so that the desired steel may be produced. Among others detection of the carbon content of the molten steel being processed is particularly important, because the primary object of the process is to decarburize the molten steel. However, it is not easy to precisely and instantaneously detect the changing carbon content of the molten steel every moment, which steel is being processed under vacuum in a closed vessel.

For the determination of the carbon content of the molten steel and control of the end point thereof various methods have heretofore been proposed, including, for example, an experimental method based on static analyses; a method wherein a rate of decarburization of the molten steel is indirectly predicted from a change in the monitored degree of vacuum of the exhaust gas, and; a method wherein a partial pressure of oxygen in the exhaust gas is monitored by means of a concentration cell, and from an inflection point of the change in the monitored partial pressure of oxygen the carbon content of the molten steel is determined. However, such known methods are unsatisfactory because of poor precision and, it has been difficult to successfully control various kinds of steel containing various quantities of Cr, Ni and Mn to end carbon levels differently desired to the respective particular products.

One approach to the problem is to precisely and instantaneously measure the amount of carbon which has been transferred to the exhaust gas, that is the quantities of CO and $CO_2$ inthe evacuated exhaust gas. Attempts have been made to measure the quantity of the exhaust gas caused to flow through a duct communicating the vacuum vessel and evacuation means, as well as the quantities of CO, $CO_2$ and $O_2$ in the exhaust gas. Infrared gas analyzers for analyses of CO and $CO_2$ and a magnetic gas analyzer for analysis of $O_2$ have heretofore been utilized. However, such instruments have a limited precision and response speed so that it is difficult to know a precise carbon level of the molten steel every moment from information obtained with such instruments. Moreover, these instruments have been inherently designed for analyses of gases under atmospheric pressure, and therefore, upon analysis of a gas under a reduced pressure a waiting period is required before a sufficient volume of the gas for analysis accumulates, rendering the response speed and precision of the instruments still worse. In order to avoid such a waiting period, a proposal has been made wherein the evacuated exhaust gas is sampled for analysis purpose at the discharge side of the evacuation means. However, no satisfactory results have been obtained by such a proposal. This is because the measurement involves errors corresponding to the fraction of the $CO_2$ which is dissolved in water condensed by the condensers **6*a* through 6*d*** and removed from the system. Furthermore, the fact that different gas analyzers are required for detecting different gaseous components in a sample of the exhaust gas poses difficulties in handling errors and time-lags of the respective analyzers.

In Japanese Patent Laid-open Specification No. 50(1975)-99592, published on Aug. 7, 1975 and assigned to the assignee of the present application, we have disclosed a method of determining the quantity of a gas formed in a gas producing chamber, such as the quantity of steam formed in a drier. The method proposed therein comprises the steps of feeding a dummy gas to the gas producing chamber, monitoring the quantity of the dummy gas fed to the gas producing chamber as well as the partial pressures of the dummy gas and the gas formed contained in an exhaust gas, and determining the quantity of the gas formed from the monitored values. The laid-open specification further teaches that the partial pressures of the gases may be advantageously measured by a mass spectrometer, and suggests that the proposed method may be applicable for determination of gases formed in a steel making furnace. However, this laid-open specification is completely silent with respect to difficulties inherently involved in mass spectrometrical analysis of a gas comprising CO, $CO_2$ and $N_2$. In fact, parent peaks for CO and $N_2$ in a mass spectrum are inseparable because CO and $N_2$ have the same mass number of 28. Moreover, a fragment peak for $CO_2$ appears at a mass number of 28 and perturbs the parent peak for CO which also appears at the same mass number. Furthermore, there are additional difficulties in the mass spectrometry of the exhaust gas compulsively evacuated in the decarburization process of molten steel under reduced pressures, owing to the fact that on one hand a sensitivity of a mass spectrometer for a gas varies depending upon the pressure of the gas, and on the other hand the pressure of the evacuated exhaust gas varies to a great extent in the course of vacuum decarburization of the molten steel. The laid-open specification is also completely silent with respect to such difficulties.

SUMMARY OF THE INVENTION

An object of the invention is to provide an improved method for a dynamic control of a steel making process which involves decarburization of molten steel in a closed zone under reduced pressures and compulsive evacuation of an exhaust gas comprising CO, $CO_2$ and $N_2$ from the closed zone. A method in accordance with the invention comprises the steps of forming an intimate gaseous mixture of the exhaust gas and a measured quantity of a reference gas which is inert to the exhaust gas; mass spectrometrically monitoring a sample of said intimate mixture for the ionization currents for selected peaks with which the CO, $CO_2$, $N_2$ and reference gas in said sample are concerned; determining the rate or amount of decarburization of the molten steel at the time of monitoring from the measured value of the quantity of the reference gas in said mixture and the measured values of the ionization currents for the selected peaks, and; controlling the steel making process in accordance with the determined value of the rate or amount of decarburization of the molten steel.

BRIEF DESCRIPTION OF THE DRAWINGS

A more complete appreciation of the invention and many of the attendant advantages thereof will readily be obtained as the same becomes better understood by reference to the following detailed description when considered in connection with the accompanying drawings, in which.

DETAILED DESCRIPTION OF THE INVENTION

Figure 1:
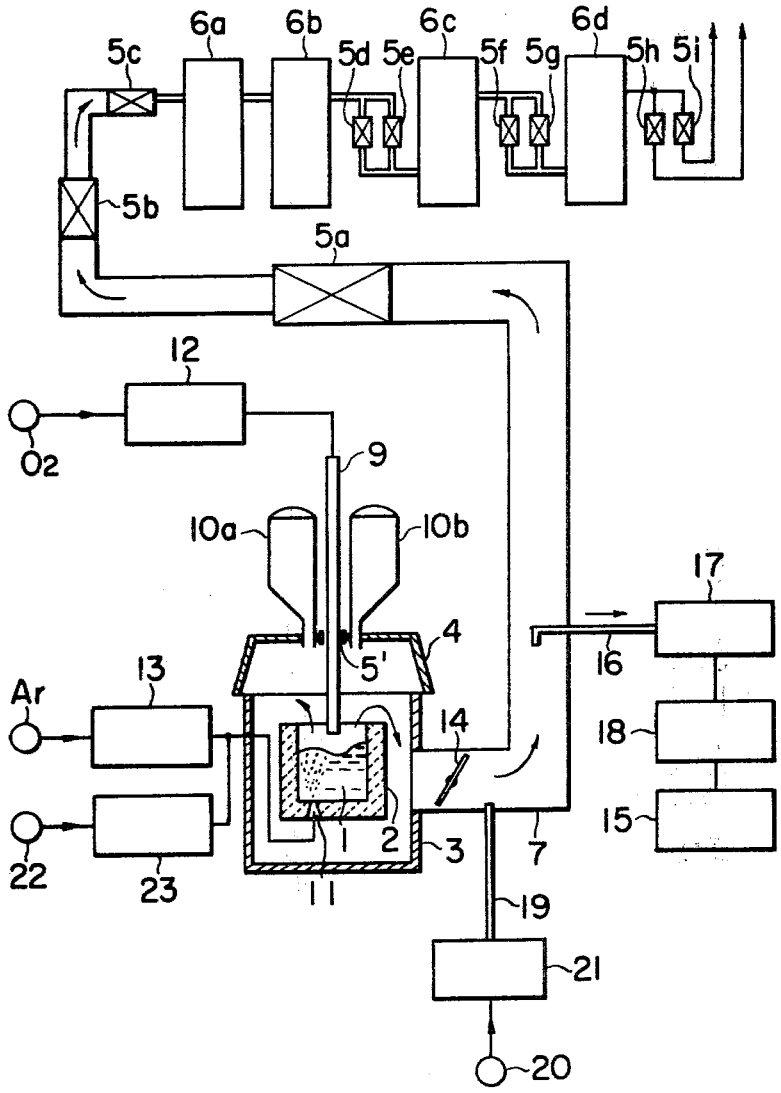
FIG. 1 illustrates an arrangement of instruments which may be used in an embodiment of the method of the invention for controlling a steel making process carried out in a VOD furnace under reduced pressures.

Referring to FIG. 1, a molten steel 1 to be processed, for example, a molten steel containing chromium and having an initial carbon content of 0.2 to 0.5% by weight, is contained in a ladle 2 located in a closed vessel 3. The vessel 3 has an air-tight cover 4 and is communicated with an evacuation means comprising steam ejectors 5*a* through 5*i* and condensers 6*a* through 6*d* via a duct 7. The cover 4 is provided with a vertically movable lance 9 and hoppers 10*a* and 10*b* for supplying alloying elements and flux. The ladle 2 is provided at the bottom with a porous plug 11.

When operating the so constructed VOD furnace, the ladle is charged with a molten steel which has been partially decarburized in a converter or electric furnace; a reduced pressure is created in the closed vessel 3 by driving the steam ejectors 5*a* through 5*i* and condensers 6*a* through 6*d*, and; while maintaining the reduced pressures in the vessel 3, oxygen is blown through the lance 9 onto the molten steel 1 in the ladle 2. The quantity of oxygen blown is controlled by means of a pressure and flow controller 12. In the course of this blowing of oxygen the molten steel 1 is stirred by blowing argon thereinto through the porous plug 11 provided at the bottom of the ladle 2. The quantity of argon blown is controlled by means of a pressure and flow controller 13.

In the course of the blowing process, carbon in the molten steel reacts with the blown oxygen to provide CO and $CO_2$ which are compulsively evacuated through the duct 7. Thus, the exhaust gas caused to flow through the duct 7 comprises, in addition to the CO and $CO_2$, argon blown through the porous plug 11, unreacted oxygen blown through the lance 9, air having remained in the vessel 3, and air which has leaked in through any clearances between the vessel 3 and cover 4, and between the cover 4, and lance 9 or hoppers 10*a* and 10*b* as well as through the portion of the duct 7 where an electrically driven sealing valve 14 is mounted. Nevertheless, as far as the evacuation means is operating all of the CO and $CO_2$ formed in the decarburization process is evacuated and caused to flow through the duct 7. Accordingly, the quantities of the CO and $CO_2$ flowing through the duct 7 correspond to the amount of decarburization of the molten steel 1.

In accordance with the invention a mass spectrometer is utilized to determine the quantities of CO and $CO_2$ flowing through the duct 7. A sample of the gas flowing through the duct 7 is introduced to a sample inlet system (not shown) of a mass spectrometer 15 from a gas inlet pipe 16 through a filter 17 by means of a suction pump 18. For successful measurements by the mass spectrometer 15, the duct 7 is provided with a reference gas inlet pipe 19 at a location at least a predetermined distance upstream of the gas inlet pipe 16 so that a reference gas 20 may be introduced through the pipe 19 to the exhaust gas system while being precisely metered by a flow meter 21. The sample is mass spectrometrically analyzed for the ionization currents for peaks at selected mass numbers. Based on the measured value of the quantity of the reference gas introduced to the system and the measured values of the ionization currents for the selected peaks, the amount or rate of decarburizaton at that distance is determined. How to carry out such a determination will now be described with reference to typical and preferred embodiments of the invention.

In accordance with a first embodiment of the method of the invention a predetermined quantity of a sample of the intimate mixture of the exhaust and reference gases is mass spectrometrically monitored for the ionization currents for peaks appearing at mass numbers of 12, 14, 28 and 44, and for the ionization current for the parent peak of the reference gas; the partial pressures of the CO and $CO_2$ in the exhaust gas are calculated from the measured values of the ionization currents for the peaks at mass numbers of 12, 14, 28 and 44; the quantities of the CO and $CO_2$ in the exhaust gas are calculated from the calculated values of the partial pressures of the CO and $CO_2$, the measured value of the quantity of the reference gas introduced in the mixture or the value of its change with time, and the measured value of the ionization current for the parent peak of the reference gas or the value of its change with time, and; the rate or amount of decarburization of the molten steel at the time of monitoring is determined from the calculated values of the quantities of the CO and $CO_2$ in said exhaust gas.

With respect to the exhaust gas system under discussion, the following equations (1), (2), (3) and (4) are materialized.

$$X_{12}=S_{CO}\cdot\pi_{CO\cdot 12}\cdot P_{CO}+S_{CO_2}\cdot\pi_{CO_2\cdot 12}\cdot P_{CO_2} \quad (1)$$

$$X_{14}=S_{CO}\cdot\pi_{CO\cdot 14}\cdot P_{CO}+S_{N_2}\cdot\pi_{N_2\cdot 14}\cdot P_{N_2} \quad (2)$$

$$X_{28}=S_{N_2}\cdot P_{N_2}+S_{CO}\cdot P_{CO}+S_{CO_2}\cdot\pi_{CO_2\cdot 28}\cdot P_{CO_2} \quad (3)$$

$$X_{44}=S_{CO_2}\cdot P_{CO_2} \quad (4)$$

In these equations, $X_{12}$, $X_{14}$, $X_{28}$ and $X_{44}$ represent ionization currents (in ampere) at mass number (m/e) of 12, 14, 28 and 44, respectively;

$S_{CO}$, $S_{N_2}$ and $S_{CO_2}$ represent sentivities (in ampere/torr) of the mass spectrometer for CO, $N_2$ and $CO_2$, respectively;

$\pi_{CO\cdot 14}$ and $\pi_{N_2\cdot 14}$ are pattern coefficients, to a mass number (m/e) of 14, of CO and $N_2$, respectively;

$\pi_{CO\cdot 12}$ and $\pi_{CO_2\cdot 12}$ are pattern coefficients, to a mass number (m/e) of 12, of CO and $CO_2$, respectively;

$\pi_{CO_2\cdot 28}$ is a pattern coefficient of $CO_2$ to a mass number (m/e) of 28, and;

$P_{CO}$, $P_{N_2}$ and $P_{CO_2}$ represent partial pressures, in the exhaust gas, of CO, $N_2$ and $CO_2$, respectively.

The values of the ionization currents $X_{12}$, $X_{14}$, $X_{28}$ and $X_{44}$ are measured by the mass spectrometer 15. The sensitivities $S_{CO}$, $S_{N_2}$ and $S_{CO_2}$ as well as the pattern coefficients $\pi_{CO\cdot 12}$, $\pi_{CO\cdot 14}$, $\pi_{CO_2\cdot 12}$, $\pi_{CO_2\cdot 28}$ and $\pi_{N\cdot 14}$ are values inherent to the mass spectrometer 15 under particular conditions of measurements, and, therefore are already known or can be determined by preliminary experiments. Accordingly, it will be noted that there are 4 equations (1) through (4), for 3 variables, $P_{CO}$, $P_{N_2}$ and $P_{CO_2}$. Thus, the values of $P_{CO}$, $P_{N_2}$ and $P_{CO_2}$ can be calculated from these 4 equations, by the so-called least squares method. Alternatively, a set of three equations, for example, (4), (1) and (2); (4), (2) and (3), or; (4), (1) and (3), may be selected to calculate the values of $P_{CO}$, $P_{N_2}$ and $P_{CO_2}$. Of course the selection should be desirably made so that any possible errors may be minimized. For example, if any hydrocarbons are present in the sample of the exhaust gas, a fragment peak thereof frequently appears at a mass number of 12, and perturbs the value of $X_{12}$. If such a perturbation due to hydrocarbons cannot be neglected, it is preferred to select equations (2), (3) and (4) for calculating the partial pressures. It has also been found that when a solution from a set of suitably selected three equations is utilized for actual control of the decarburization process, other sets of three equations may be advantageously utilized for sequence check of a computer or for maintenance check of the mass spectrometer.

If the equations (2), (3) and (4) are utilized, solutions for $P_{CO}$ and $P_{CO_2}$ are as follows.

$$P_{CO}=\frac{X_{14}+\pi_{CO_2\cdot 28}\cdot\pi_{N_2\cdot 14}\cdot X_{44}-\pi_{N_2\cdot 14}\cdot X_{28}}{S_{CO}(\pi_{CO\cdot 14}-\pi_{N_2\cdot 14})} \quad (5)$$

$$P_{CO_2}=\frac{X_{44}}{S_{CO_2}} \quad (6)$$

Once the partial pressures of the CO and $CO_2$ in the exhaust gas have been determined, the contents of the CO and $CO_2$ in the exhaust gas may be theoretically determined by the following equations:

$$q_{CO}=\frac{P_{CO}}{P}\times Q$$

$$q_{CO_2}=\frac{P_{CO_2}}{P}\times Q$$

wherein $q_{CO}$ and $q_{CO_2}$ respectively represent the contents of the CO and $CO_2$ in the exhaust gas, $P_{CO}$ and $P_{CO_2}$ are the calculated values of the partial pressures of the CO and $CO_2$, respectively, P represents the total pressure of the exhaust gas, and Q represents the quantity of the exhaust gas. However, it is very difficult and impractical, although not impossible, to precisely and continuously determine the pressure and quantity of the exhaust gas formed in the steel making process, which involves decarburization of molten steel at a reduced pressure.

One of the essential features of the invention resides in the fact that the contents of the CO and $CO_2$ in the exhaust gas, i.e., $q_{CO}$ and $q_{CO_2}$ are determined without the necessity of measuring the total pressure and quantity of the exhaust gas. As already stated, in a method according to the invention a reference gas is introduced to the system through the reference gas inlet pipe 19 or through the porous plug 11 in limited cases, while being precisely metered. A change in the quantity of the reference gas introduced to the system, $\Delta q_A$, and a change in the ionization current for the parent peak, of the reference gas, $\Delta X_A$ (in ampere) are monitored. Accordingly, provided that the reference gas introduced to the system has uniformly dispersed in the exhaust gas, the following equations (7) and (8) are materialized:

$$\Delta X_A=S_A\cdot\Delta P_A \quad (7)$$

$$Q/P=\Delta q_A/\Delta P_A \quad (8)$$

wherein $\Delta X_A$, Q, P and $\Delta q_A$ are as defined herein above, $S_A$ (in ampere/torr) is a sensitivity of the mass spectrometer 15 for the reference gas, and $\Delta P_A$ represents a change in the partial pressure of the reference gas in the sample. From the equations (7) and (8), the following equation (9) directly follows:

$$Q/P=(S_A/\Delta X_A)\cdot\Delta q_A \quad (9)$$

Thus, $q_{CO}$ and $q_{CO_2}$ can be calculated in accordance with the equations (10) and (11), $$q_{CO}=P_{CO}\cdot\frac{Q}{P}=\frac{S_A}{\Delta X_A}\cdot\Delta q_A\cdot P_{CO} \quad (10)$$

$$q_{CO_2}=P_{CO_2}\cdot\frac{Q}{P}=\frac{S_A}{\Delta X_A}\cdot\Delta q_A\cdot P_{CO_2} \quad (11)$$

from the calculated values of $P_{CO}$ and $P_{CO_2}$, the measured value of the change in the quantity of the reference gas, $\Delta q_A$, the measured value of the change in the ionization current for the parent peak of the reference gas $\Delta X_A$, and the known or predetermined sensitivity of the mass spectrometer for the reference gas, $S_A$.

We can now express the rate of decarburization of the molten steel at the time of t, dC/dt, as follows.

$$-(dC/dt)=K[q_{CO}(t)+q_{CO_2}(t)] \quad (12)$$

wherein $q_{CO}(t)$ and $q_{CO_2}(t)$ are quantities of CO and $CO_2$, respectively, at the time of t in the course of the decarburization process, and K is a constant. Accordingly, the amount of decarburization as of the time t, $\Delta C$ (in %) will be determined as follows.

$$\Delta C=K'\int_0^t[q_{CO}(t)+q_{CO_2}(t)]+B \quad (13)$$

wherein K' is a constant, and B is a bias constant.

Thus, by monitoring $X_{12}$, $X_{14}$, $X_{28}$, $X_{44}$ and $\Delta X_A$ by means of the mass spectrometer 15 and also $\Delta q_A$ by means of the flowmeter 21 or 23, the amount of decarburization of the molten steel $\Delta C$ (in %) can be determined. The determination can be made instantaneously by transmitting the output signals of the mass spectrometer and flowmeter to a computer having a program for solution of the equations (1) through (4) and (10) through (13), for real time processing.

The reference gas used in a method according to the invention should be non-reactive with the exhaust gas and should not be denatured in the exhaust gas. Furthermore, the reference gas should desirably be capable of being precisely detected by the mass spectrometer irrespective of changes in the temperature and flow rate of the reference gas. In general, an inert gas, such as Ar, He or $N_2$, is suitably employed as the reference gas in the practice of the invention. In any case, however, the location in the installation where the reference gas is blown into the system and the manner of blowing (for example, whether the gas is blown continuously or intermittently) should be suitably selected depending upon the nature of the particular reference gas. When He is used as the reference gas, it may be introduced through the reference gas inlet pipe 19 to the duct 7, or it may be supplied from a source of He 22 through a flowmeter 23 and the porous plug 11 to the molten steel 1 being processed in the ladle 2 together with or separately from the argon for stirring the molten steel (FIG. 1). He as the reference gas may be introduced to the system either intermittently or continuously. When Ar is used as the reference gas it must be introduced to the system intermittently, and $\Delta q_A$ that is the difference between the quantities of Ar in the exhaust gas when the Ar reference gas is being introduced and when the introduction of the Ar reference gas is ceased, as well as $\Delta X_{40}$ that is the difference between the ionization currents at m/e=40 when the Ar reference gas is being introduced and when the introduction of the Ar reference gas is ceased must be monitored. Such intermittent introduction of argon as the reference gas is necessary in order to eliminate or minimize possible perturbation of $X_{40}$ due to argon blown through the porous plug 11, argon which is present in the oxygen blown through the lance 9 (normally, about 0.1% by volume of Ar is contained in oxygen used in the VOD process) and argon which is present in the atmospheric air leaked into the system (normally, about 0.93% by volume of Ar is contained in atmospheric air). Furthermore, introduction of Ar as the reference gas through the porous plug 11 is not advantageous. This is because the intensity of stirring of the molten steel and in turn the rate of decarburization in the VOD process are inadvertently affected by such a manner of introduction of the reference gas. Accordingly, Ar as the reference gas should preferably be introduced to a stream of the exhaust gas through the reference gas inlet pipe 19. When $N_2$ is used as the reference gas it is again necessary to intermittently introduce to the stream of the exhaust gas through the reference gas inlet pipe 19 in order to avoid reaction of the reference gas with the molten steel and to eliminate or minimize perturbations due to inadvertent entrance of $N_2$ to the system.

In practice of the invention at least a measurable amount of the reference gas should be used. Although depending upon the sensitivity for the reference gas of the particular mass spectrometer used, 0.001% by volume or more, based on the exhaust gas, of the reference gas may be typically introduced to the system at the time it is to be introduced. Obviously, it is advantageous to use the reference gas in the smallest possible amount as far as the measurements can be successfully carried out. We have found that in operation of a 40 to 50 ton VOD furnace, 10 to 30 l/min. of He, 50 to 150 l/min. of Ar or 200 to 500 l/min. of $N_2$ as the reference gas is suitable in general.

When the reference gas is introduced to the stream of the exhaust gas caused to flow through the duct 7, the mixture should be sampled at a location sufficiently downstream of the location where reference gas in introduced to the duct 7 so that an intimate gaseous mixture of the exhaust and reference gases may be sampled. In this connection we have found that the compulsive evacuation by means of the steam ejectors 5*a* through 5*i* and condensers 6*a* through 6*d* greatly assists admixture of the exhaust and reference gases to form the intended intimate mixture.

In the first embodiment as described, it is essential to sample a predetermined weight of the intimate mixture of the exhaust and reference gases for the mass spectrometry. As is well known, the pressure of the exhaust gas varies to a great extent (for example, within the range between 0.1 torr and 760 torr) in the course of the VOD process, and a sensitivity of a mass spectrometer for a gas also varies depending upon the pressure of the gas. Accordingly, it is necessary to sample a predetermined weight of the mixture irrespective of the change in the pressure of the mixture and thereby to assist maintenance of a constant pressure in the sample inlet system of the mass spectrometer 15. For this purpose it is convenient to provide control valves (not shown), whose conductances are variable inversely proportionally to the pressure of the sampled gas, in a piping leading to the sample inlet system of the mass spectrometer 15.

In accordance with a second embodiment of the method of the invention, the sample of the intimate mixture of the exhaust and reference gases is mass spectrometrically monitored for $X_{44}$, the ionization current for a peak appearing at a mass number of 44, $X_n$ and Xm selected from the group consisting of $X_{12}$, $X_{14}$ and $X_{28}$, the ionization currents for peaks appearing at mass numbers of 12, 14 and 28, respectively, and $X_A$, the ionization current for the parent peak of the reference gas; $q_{CO}+q_{CO_2}$, the sum of the quantities of the CO and $CO_2$ in the exhaust gas is determined in accordance with the equation:

$$q_{CO} + q_{CO_2} = \frac{\Delta q_A}{\Delta X_A}(a_1X_n + a_2X_m + a_3X_{44}) + \alpha \qquad (14)$$

wherein $\Delta q_A$ is the change with time of the value of the measured quantity of the reference gas in said mixture, $\Delta X_A$ is the change in $X_A$ with time, $a_1$, $a_2$ and $a_3$ are constants predetermined by carrying out the steel making process at least three times, $\alpha$ is a bias coefficient, and $q_{CO}+q_{CO_2}$, $\Delta X_A$, $X_n$, $X_m$ and $X_{44}$ are as hereinabove defined, and; the rate or amount of decarburization of the molten steel at the time of monitoring is determined from the thus determined value of $q_{CO}+q_{CO_2}$. In order to explain this embodiment, let us consider a case wherein $X_{14}$ and $X_{28}$ are selectively monitored in addition to $X_{44}$ and $X_A$. From the equations (2) through (4), (8) and (9), we can obtain the following equation $$q_{CO} + q_{CO_2} = \frac{\Delta q_A}{\Delta X_A}(a_1X_{14} + a_2X_{28} + a_3X_{44}) \qquad (14')$$

wherein $a_1$, $a_2$ and $a_3$ are as follows.

$$a_1 = \frac{S_A}{S_{CO}} \cdot \frac{1}{\pi_{CO\cdot 14} - \pi_{N2\cdot 14}}$$

$$a_2 = \frac{S_A}{S_{CO}} \cdot \frac{\pi_{N2\cdot 14}}{\pi_{CO\cdot 14} - \pi_{N2\cdot 14}}$$

$$a_3 = \frac{S_A}{S_{CO2}} + \frac{S_A}{S_{CO}} \cdot \frac{\pi_{CO2\cdot 28} \cdot \pi_{N2\cdot 14}}{\pi_{CO\cdot 14} - \pi_{N2\cdot 14}}$$

Because the $a_1$, $a_2$ and $a_3$ are constants for the particular system, as noted above, they may be predetermined by repeating the same process at least three times. Once the $a_1$, $a_2$ and $a_3$ have been predetermined, it is possible to determine $q_{CO}+q_{CO2}$, the sum of the quantities of the CO and $CO_2$ in the exhaust gas in accordance with the equation:

$$q_{CO} + q_{CO2} = \frac{\Delta q_A}{\Delta X_A}(a_1X_{14} + a_2X_{28} + a_3X_{44}) + \alpha \quad (14'')$$

wherein $\alpha$ is a bias coefficient, by monitoring $\Delta q_A$, $\Delta X_A$, $X_{14}$, $X_{28}$ and $X_{44}$. From the so determined value of $q_{CO}+q_{CO2}$, the rate of decarburization (-dC/dt) and the amount of decarburization ($\Delta C$) at the time of monitoring can be determined in accordance with the equation (10) and (11), respectively.

The second embodiment just described above is advantageous in that it is not necessary to predetermine the respective sensitivities S and pattern coefficients $\pi$. This embodiment is particularly useful when plural heats are repeatedly carried out under substantially the same conditions using the same installation. With respect to the nature of the reference gas, the manner of introduction of the reference gas and the quantity of the reference gas to be introduced to the system, the descriptions hereinabove given regarding the first embodiment are applicable. However, it is not critical, although preferred, to sample a predetermined quantity (weight) of the mixture of the exhaust and reference gases. This is because the ratios of the sensitivities, such as $S_A/S_{CO}$ and $S_A/S_{CO2}$, are not affected by the change in the pressure of the gas, although the individual sensitivities, $S_A$, $S_{CO}$ and $S_{CO2}$, vary depending upon the pressure. This is an additional important advantage of the second embodiment.

In a third embodiment of the method of the invention, using Ar as the reference gas, the sample of the intimate mixture of the exhaust and reference gases is mass spectrometrically monitored for $X_{28}$, $X_{40}$ and $X_{44}$, the ionization currents for peaks appearing at masss numbers of 28, 40 and 44, respectively; $q_{CO}+q_{CO2}$, the sum of the quantities of the CO and $CO_2$ in the exhaust gas is determined in accordance with the equation:

$$q_{CO} + q_{CO2} = b_1\frac{X_{28}}{\Delta X_{40}} \cdot \Delta q_{Ar} + b_2\frac{X_{40}}{\Delta X_{40}} \cdot \Delta q_{Ar} + b_3\frac{X_{44}}{\Delta X_{40}} \cdot \Delta q_{Ar} + b_4 \quad (14''')$$

wherein $\Delta q_{Ar}$ is the change with time of the value of the measured quantity of Ar as the reference gas in said mixture, $\Delta X_{40}$ is the change with time of $X_{40}$, $b_1$, $b_2$, $b_3$ and $b_4$ are constants predetermined by carrying out the steel making process at least four times, and $q_{CO}+q_{CO2}$, $X_{28}$, $X_{40}$ and $X_{44}$ are as hereinabove defined, and; the rate or amount of decarburization of the molten steel at the time of monitoring is determined from the thus determined value of $q_{CO}+q_{CO2}$. Assuming that Q is the unknown quantity of the exhaust gas;

P is the unknown total pressure of the exhaust gas;

L is the unknown quantity of air leaked into the system;

$q_{O2}$ is the quantity of oxygen blown through the lance 9;

$C'_{Ar}$ is the content of Ar in the oxygen blown;

$PP_{Ar}$ is the quantity of Ar blown through the porous plug;

$C_{N2}$ is the content of $N_2$ in air;

$C_{Ar}$ is the content of Ar in air;

$S_{Ar}$ is the sensitivity of the mass spectrometer 15 for Ar;

$P_{Ar}$ is the partial pressure of Ar in the exhaust gas;

$\Delta P_{Ar}$ is the change in $P_{Ar}$ with time;

$q_{Ar}$ is the quantity of Ar in the exhaust gas;

$\Delta q_{Ar}$ is the change in $q_{Ar}$ with time caused by introduction of Ar as the reference gas, and;

$\Delta X_{40}$ is the change in $X_{40}$ with time, the following equations are materialized:

$$Q/P = \Delta q_{Ar}/\Delta P_{Ar} = q_{CO2}/P_{CO2} = q_{CO}/P_{CO} = q_{N2}/P_{N2} = q_{Ar}/P_{Ar} \quad (15)$$

$$\Delta X_{40} = S_{Ar} \cdot \Delta P_{Ar} \text{ and } X_{40} = S_{Ar} \cdot P_{Ar} \quad (16)$$

$$q_{N2} = C_{N2} \cdot L \quad (17)$$

$$q_{Ar} = C_{Ar} \cdot L + C'_{Ar}q_{O2} + PP_{Ar} \quad (18)$$

From the equations (3), (4), and (15) and (18), the following equation is obtained:

$$q_{CO} + q_{CO2} = b_1\frac{X_{28}}{\Delta X_{40}} \cdot \Delta q_{Ar} + b_2\frac{X_{40}}{\Delta X_{40}} \cdot \Delta q_{Ar} + b_3\frac{X_{44}}{\Delta X_{40}} \cdot \Delta q_{Ar} + b_4 \quad (19)$$

wherein $b_1$, $b_2$, $b_3$ and $b_4$ are as follows.

Figure 3:
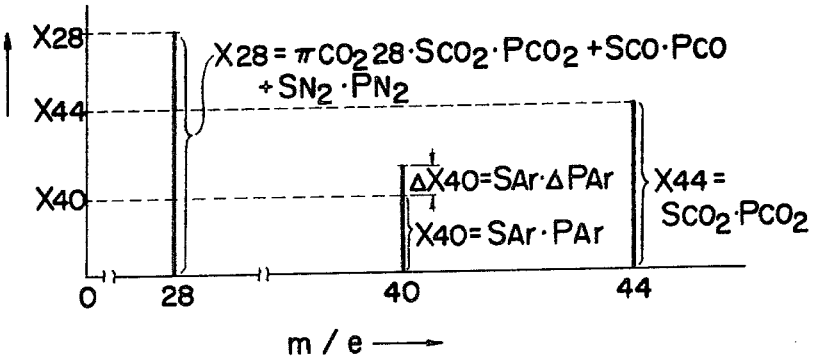
FIG. 3 diagrammatically illustrates an imaginary construction of a certain mass spectrum obtained in the third embodiment of the method of the invention.

$b_1 = S_{Ar}/S_{CO}$ $b_2 = -S_{N2}/S_{CO} \cdot C_{N2}/C_{Ar}$ $b_3 = S_{Ar}/S_{CO2} - \pi_{CO2\cdot 28} \cdot S_{Ar}/S_{CO}$ and $b_4 = S_{N2}/S_{CO} \cdot C_{N2}/C_{Ar}(C'_{Ar}q_{O2} + PP_{Ar})$ Because the $b_1$, $b_2$, $b_3$ and $b_4$ are constants for the particular system, as noted above, they may be predetermined by repeating the same process at least four times. Once the $b_1$, $b_2$, $b_3$ and $b_4$ have been predetermined, it is possible to determine $q_{CO}+q_{CO2}$ in accordance with the equation (19) by monitoring $X_{28}$, $X_{40}$, $X_{44}$, $\Delta X_{40}$ and $\Delta q_{Ar}$. FIG. 3 diagrammatically illustrates the ionization currents $X_{28}$, $X_{40}$ and $X_{44}$, represented by the equations (3), (16) and (4), for peaks at mass numbers of 28, 40 and 44. From the so determined value of $q_{CO}+q_{CO2}$, the rate of decarburization($-dC/dt$) ($\Delta C$) and the amount of decarburization at the time of monitoring can be determined in accordance with the equations (12) and (13), respectively.

The third embodiment just described above is advantageous in that it is not necessary to predetermine the respective sensitivities S and pattern coefficients $\pi$. This embodiment is particularly useful when plural heats are repeatedly carried out under substantially the same conditions using the same installation. Argon as the reference gas may be intermittently introduced through the reference gas inlet pipe 19 to the stream of the exhaust gas. With respect to the quantity of the reference gas to be introduced to the system, the descriptions hereinabove given regarding the first embodiment are applicable. However, it is not critical, although preferred, to sample a predetermined quantity (weight) of the mixture of the exhaust and reference gases for the same reasons as hereinabove described regarding the second embodiment. Furthermore, when compared with the second embodiment the third embodiment can afford more precise results.

Based upon the determined amount of decarburization or rate of decarburization, the molten steel in the course of the decarburization process is controlled to the desired conditions. Particularly, when the decarburization process is carried out in a plurality of stages, the carbon content of the molten steel at the end point of each stage is controlled to a preset value by suitably adjusting the amount of oxygen blown, the pressure and proportions of the mixed blown gas, addition of alloying elements, amount of slags and other parameters affecting the system.

The invention will be further described by the following Examples.

EXAMPLE 1

The example illustrates the first embodiment of the method of the invention.

Figure 2:
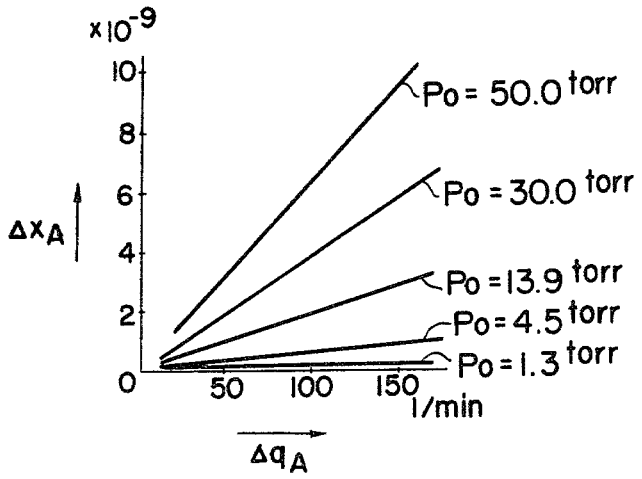
FIG. 2 is a graph revealing the fact that $\Delta q_A$, the change in the quantity of a reference gas introduced to the system in accordance with the invention is proportional to $\Delta X_A$, the change in the ionization current for the parent of the reference gas.

A number of preliminary tests were conducted using a 45 ton VOD furnace which is illustrated in FIG. 1. Keeping about 45 tons of a decarburized molten steel in the ladle 2, but with neither blowing of oxygen through the lance 9 nor bubbling of argon through the porous plug 11, varied quantities of argon were introduced through the reference gas inlet pipe 19 while $\Delta q_A$ was precisely metered by means of the flowmeter 21. The change in the ionization current at m/e=40, $\Delta X_A$, was measured. The measurements were repeated under different constant degrees of vacuum established by the evacuation means, while maintaining the conductances of the control valves (not shown) provided in a piping leading to the sample inlet system of the mass spectrometer 15, constant. The results are shown in FIG. 2. FIG. 2 reveals that the change in the ionization current at m/e=40, $\Delta X_A$, is substantially proportional to the change in the quantity of argon introduced as the reference gas, $\Delta q_A$, under each constant pressure. From the slope of each straight line, the sensitivity of the mass spectrometer 15 for argon under the each indicated degree of vacuum ($P_O$) may be determined.

In another preliminary test, wherein the molten steel had been removed from the ladle 2 and the blowing of oxygen and argon was not carried out, the change in the ionization current $\Delta X_A$ with the change in the quantity of argon introduced to the duct 7 through the reference gas inlet pipe 19 was monitored. Similar results were obtained.

Similar preliminary tests carried out using He or $N_2$ as the reference gas brought about similar results. However, it should be pointed out that different reference gases result in different slopes under the same degree of vacuum. A further preliminary test wherein He was used as the reference gas and was introduced through the porous plug 11 to the molten steel being processed also gave the similar results.

In the VOD furnace as used in the preliminary tests, 4 heats of stainless steel were carried out. The initial composition of the molten steel was: 0.252 to 0.286% by weight C, about 8.9% by weight Ni, about 18.3% by weight Cr, about 0.5% by weight Mn, and about 0.4% by weight Si. In the heats Nos. 1 and 2, about 45 tons of a molten steel having the above-mentioned initial composition were placed in the ladle 2 and subjected to a conventional VOD process by causing the evacuation means to start operating so as to create a reduced pressure in the furnace and continuing the operation of the evacuation means while introducing oxygen through the lance 9 and argon through the porous plug 11 to the molten steel in the ladle 2. The intended carbon content of the molten steel at the end point was 0.05% by weight. In the course of the process Ar as the reference gas was intermittently introduced through the reference gas inlet pipe 19 to the duct 7, while being precisely metered by means of the flowmeter 21. The flow rate of argon introduced through the pipe 19 was about 100 liters per minute, and the flow was stopped every 2.5 minutes for a period of 60 seconds. A predetermined weight of an intimate mixture of the exhaust gas and argon reference gas was continuously sampled through the sample inlet pipe 16 to the sample inlet system of the mass spectrometer 15, and was continuously monitored for $\Delta X_A$, $X_{14}$, $X_{28}$ and $X_{44}$. The measured values were recorded in a high speed recorder and processed by a computer with a program for solution of the equations (2) through (6) and (10) through (13) to determine the amount of decarburization, $\Delta C$ cal., of the molten steel every moment.

In the heats Nos. 3 and 4, the general procedures of the heats Nos. 1 and 2 were repeated except that He was used as the reference gas instead of the Ar and was intermittently introduced from the source of He through the porous plug 11 to the molten steel being processed while being precisely metered by means of the flowmeter 23. The flow rate of the He introduced was about 20 liters per minute, and the flow was stopped every 2.5 minutes for a period of 60 seconds.

At the end of each heat, the actual carbon content of the molten steel, C act.%, was determined by sampling of the processed molten steel and subsequent chemical analysis. For heats Nos. 1, 2, 3 and 4, the differences between the value of C act.% chemically determined and the value of C cal.% (at the end point) mass spectrometrically determined by the method of the invention, C act.−C cal., were 0.012%, −0.006%, −0.008% and 0.014%, respectively.

EXAMPLE 2

This example illustrates this second embodiment of the method of the invention.

Twenty-six heats (heats Nos. 5 through 30) of stainless steel substantially the same as the heat Nos. 3 and 4 described in Example 1 were repeated. The data obtained in the heats Nos. 5 through 12 were utilized for the determination of the constants $a_1$, $a_2$ and $a_3$ in the equation (14″). In each of the remaining 18 heats Nos. 13 through 30, $\Delta q_A$, $\Delta X_4$, $X_{14}$, $X_{28}$ and $X_{44}$ were continuously monitored by means of the mass spectrometer 15 and flowmeter 23, and the monitored values were processed by a computer with a program for a solution of the equations (12) and (13) in order to determine the carbon content of the molten steel every moment. At the end of each heat the actual carbon content of the molten steel, C act.%, was determined at the end point of the process by chemical analysis. The different between the value of the C% mass spectrometrically predicted by the method of the invention and the value of C act.% chemically determined was within the range of ±0.020%C for 16 heats of the 18 heats.

EXAMPLE 3

This example illustrates the third embodiment of the method of the invention.

Thirty-two heats (heats Nos. 31 through 62) of stainless steel substantially the same as the heat Nos. 1 and 2 described in Example 1 were repeated. The data obtained in the heats Nos. 31 through 40 were utilized for the determination of the constants $b_1$, $b_2$, $b_3$ and $b_4$ in the equation (14''). In each of the remaining 22 heats Nos. 41 through 62, $\Delta q_{Ar}$, $\Delta X_{40}$, $X_{28}$, $X_{40}$ and $X_{44}$ were continuously monitored by means of the mass spectrometer 15 and flowmeter 21, and the monitored values were processed to determine the carbon content of the molten steel being processed every moment by a computer which had a program for a solution of the equations (12) and (13). At the end of each heat the actual carbon content of the molten steel, C act.%, was determined by chemical analysis. For 21 heats of the 22 heats, the difference between the values actually determined by chemical analysis and mass spectrometrically predicted by the method of the invention was within the range of ±0.015%C.

The invention brings about various advantages. First of all the determination is precise, consistent and instantaneous. The fact that a small volume of samples may suffice for measurements makes the means required for filtering such samples be simple and the period of time for transferring such samples to the mass spectrometer be short. Moreover, the contents of CO and $CO_2$ in the sampled gas may be determined simultaneously by one and the same instrument within a short period of time in the order of milli-seconds without necessity to measure the quantity of the entire exhaust gas. Because the monitored parameters (ionization currents) are of an electrical nature they may be directly and readily transmitted to a suitable recorder and computer for real time processing. Thus, it is possible to determine the amount or rate of decarburization every moment.

While the invention has been described in Examples with respect to a typical VOD process, the method of the invention is applicable in various processes or stages as far as such processes or stages involve decarburization of molten steel under reduced pressures in a closed zone and compulsive evacuation of the exhaust gas from the closed zone irrespective of oxygen blowing and argon bubbling. Furthermore, in place of controlling the steel making process according to the integrated C% of the equation (13) and the initial C%, the process may also be controlled by utilizing the rate of decarburization determined at a certain time in conjunction with a decarburization model separately predetermined for the particular steel being prepared. Various modifications will be apparent to those skilled in the art without departing from the scope and spirit of the invention.

What we claim is:

1. A method of determining rate of decarburization of molten steel being decarburized under reduced atmospheric pressures, which comprises;

continuously evacuating the exhaust gases of decarburization from the zone containing the molten steel;

forming an intimate gaseous mixture of the decarburization exhaust gases and a predetermined quantity of a reference gas which is inert to the exhaust gas; said exhaust gases comprising CO, $CO_2$ and $N_2$;

mass spectrometrically monitoring a sample of said mixture for the ionization currents for peaks with which the CO, $CO_2$, $N_2$ and reference gas in said sample are associated; and determining the rate of decarburization from a comparison of the quantity of the reference gas in said mixture and the values of the ionization currents for the peaks.

2. In a method of making steel of a predetermined carbon content, which comprises;

providing a molten steel having a carbon content higher than said predetermined content in a closed zone, under reduced atmospheric pressures;

continuously removing exhaust gases from the closed zone;

decarburizing the molten steel;

determining the CO and $CO_2$ content of the exhaust gases from the closed zone;

calculating the rate of decarburization using the values obtained from said determination; and adjusting at least one of the parameters affecting the decarburization as necessary to arrive at the predetermined carbon content, based on the calculated rate of decarburization;

the improvement which comprises;

calculating the rate of decarburization by the steps of;

forming a gaseous mixture of the exhaust gas and a measured quantity of a reference gas which is inert to the exhaust gas;

mass spectrometrically monitoring said mixture for $X_{12}$, $X_{14}$, $X_{28}$ and $X_{44}$, the ionization currents for peaks at mass numbers of 12, 14 and 28, respectively, and $X_A$, the ionization current for the parent peak of the reference gas;

calculating $P_{CO}$ and $P_{CO_2}$, the partial pressures of the CO and $CO_2$ in the exhaust gas from the values of the ionization currents for peaks at mass numbers of 12, 14, 28 and 44 by solving the equations:

1. $X_{12}=S_{CO}\cdot\pi_{CO\cdot 12}\cdot P_{CO}+S_{CO_2}\cdot\pi_{CO_2\cdot 12}\cdot P_{CO_2}$
2. $X_{14}=S_{CO}\cdot\pi_{CO\cdot 14}\cdot P_{CO}+S_{N_2}\cdot\pi_{N_2\cdot 14}\cdot P_{N_2}$
3. $X_{28}=S_{N_2}\cdot P_{N_2}+S_{CO}\cdot P_{CO}+S_{CO_2}\cdot\pi_{CO_2\cdot 28}\cdot P_{CO_2}$ and 4. $X_{44}=S_{CO_2}\cdot P_{CO_2}$ wherein $S_{CO}$, $S_{N_2}$ and $S_{CO_2}$ are sensitivities of the mass spectrometer for the CO, $N_2$ and $CO_2$, respectively;

$\pi_{CO\cdot 14}$ and $\pi_{N_2\cdot 14}$ are pattern coefficients, to a mass number of 14, of the CO and $N_2$, respectively;

$\pi_{CO\cdot 12}$ and $\pi_{CO_2\cdot 12}$ are pattern coefficients, to a mass number of 12, of the CO and $CO_2$, respectively;

$\pi_{CO_2\cdot 28}$ is a pattern coefficient of the $CO_2$ to a mass number of 28;

$X_{12}$, $X_{14}$, $X_{28}$, $X_{44}$, $P_{CO}$, $P_{N_2}$ and $P_{CO_2}$ have the meanings as defined above; and calculating $q_{CO}$ and $q_{CO_2}$, the CO and $CO_2$ contents in the exhaust gas from the calculated values of the partial pressured of the CO and $CO_2$, the value of the quantity of the reference gas in said mixture, and the value of the ionization current for the parent peak of the reference gas, in accordance with the equations:

$$q_{CO}=\frac{S_A}{\Delta X_A}\cdot\Delta q_A\cdot P_{CO} \text{ and} \qquad 10.$$

$$q_{CO_2}=\frac{S_A}{\Delta X_A}\cdot\Delta q_A\cdot P_{CO_2} \qquad 11.$$

wherein $S_A$ is a sensitivity of the mass spectrometer for the reference gas, $\Delta q_A$ is the change with time of the measured value of the quantity of the reference gas in said mixture, $\Delta X_A$ is the change in $X_A$ with time and $X_A$, $P_{CO_2}$ have the meanings as defined above; and calculating the rate of decarburization at the time of monitoring from the thus calculated value of $q_{CO}+q_{CO_2}$.

3. In a method of making steel of a predetermined carbon content, which comprises:

providing a molten steel having a carbon content higher than said predetermined content in a closed zone, under reduced atmospheric pressures;

continuously removing exhaust gases from the closed zones;

decarburizing the molten steel;

determining the CO and $CO_2$ content of the exhaust gases from the closed zone;

calculating the rate of decarburization using the values obtained from said determination; and adjusting at least one of the parameters affecting the decarburization as necessary to arrive at the predetermined carbon content, based on the calculated rate of decarburization;

the improvement, which comprises;

calculating the rate of decarburization by the steps of;

forming a gaseous mixture of the exhaust gas and a measured quantity of a reference gas which is inert to the exhaust gas;

mass spectrometrically monitoring said mixture for $X_{44}$, the ionization current for a peak appearing at a mass number of 44, Xn and Xm selected from the group consisting of $X_{12}$, $X_{14}$ and $X_{28}$, the ionization currents for peaks appearing at mass numbers of 12, 14 and 28, respectively, and $X_A$, the ionization current for the parent peak of the reference gas;

determining $q_{CO}+q_{CO_2}$, the sum of quantities of the CO and $CO_2$ in the exhaust gas in accordance with the equation:

$$q_{CO} + q_{CO_2} = \frac{\Delta q_A}{\Delta X_A}(a_1X_n + a_2Xm + a_3X_{44}) + \alpha$$

wherein $\Delta q_A$ is the change with time of the value of the measured quantity of the reference gas in said mixture, $\Delta X_A$ is the change in $X_A$ with time, $a_1$, $a_2$ and $a_3$ are constants predetermined by carrying out the steel making process at least three times, $\alpha$ is a bias coefficient, and $q_{CO}+q_{CO_2}$, $X_A$, Xn, Xm and $X_{44}$ are as hereinabove defined; and calculating the rate of decarburization of the molten steel at the time of monitoring from the thus determined value of $q_{CO}+q_{CO_2}$.

4. In a method of making steel of a predetermined carbon content, which comprises:

providing a molten steel having a carbon content higher than said predetermined content in a closed zone, under reduced atmospheric pressures;

continuously removing exhaust gases from the closed zone;

decarburizing the molten steel;

determining the CO and $CO_2$ content of the exhaust gases from the closed zone, calculating the rate of decarburization using the values obtained from said determination; and adjusting at least one of the parameters affecting the decarburization as necessary to arrive at the predetermined carbon content, based on the calculated rate of decarburization;

the improvement which comprises;

calculating the rate of decarburizattion by the steps of;

forming a gaseous mixture of the exhaust gas and a measured quantity of a reference gas which is inert to the exhaust gas;

mass spectrometrically monitoring said mixture for $X_{28}$, $X_{40}$ and $X_{44}$, the ionization currents for peaks appearing at mass numbers of 28, 40 and 44, respectively;

determining $q_{CO}+q_{CO_2}$, the sum of the quantities of the CO and $CO_2$ in the exhaust gas in accordance with the equation:

$$q_{CO} + q_{CO_2} = b_1\frac{X_{28}}{\Delta X_{40}}\cdot q_{Ar} + b_2\frac{X_{40}}{\Delta X_{40}}\cdot \Delta q_{Ar} + b_3\frac{X_{44}}{X_{40}}\cdot \Delta q_{Ar} + b_4$$

wherein $q_{Ar}$ is the change with time of the value of the quantity of the reference gas in said mixture, $X_{40}$ is the change with time of $X_{40}$, $b_1$, $b_2$, $b_3$ and $b_4$ are constants predetermined by carrying out the steel making process at least four times, and $q_{CO}+q_{CO_2}$, $X_{28}$, $X_{40}$ and $X_{44}$ are as hereinabove defined; and calculating the ratio of decarburization of the molten steel at the time of monitoring from the thus determined value of $q_{CO}+q_{CO_2}$.

5. The improved method of claim 2, wherein the reference gas is selected from the group consisting of Ar, He and $N_2$, and is intermittently introduced in a stream of the exhaust gas.

6. The improved method of claim 2, wherein the reference gas in He, and is intermittently or continuously introduced in the molten steel.

7. The improved method of claim 3, wherein a predetermined quantity of said intimate mixture of the exhaust and reference gases is mass spectrometrically monitored.

8. The improved method of claim 3 wherein the reference gas is selected from the group consisting of Ar, He and $N_2$, and is intermittently introduced in a stream of the exhaust gas.

9. The improved method of claim 3 wherein the reference gas is He, and is intermittently introduced in the molten steel.

10. The improved method of claim 4, wherein a predetermined quantity of said intimate mixture of the exhaust and reference gases is mass spectrometrically monitored.

11. The improved method of claim 4 wherein the reference gas is intermittently introduced in a stream of the exhaust gas.

* * * * *

UNITED STATES PATENT AND TRADEMARK OFFICE

CERTIFICATE OF CORRECTION

PATENT NO. : 4,251,269

DATED : February 17, 1981

INVENTOR(S) : Fumio Hoshi et al

It is certified that error appears in the above—identified patent and that said Letters Patent is hereby corrected as shown below:

Col. 4, line 35, - "distance" should read -- instance --

Col. 5, line 21, - "$\pi$N.14" should read -- $\pi N_2 \cdot 14$ --

Col. 8, line 9, - "in" should read -- is --

Col. 9, line 52, - "masss" should read -- mass --

Signed and Sealed this

*Third* Day of *November 1981*

[SEAL]

*Attest:*

GERALD J. MOSSINGHOFF

*Attesting Officer*

*Commissioner of Patents and Trademarks*